US005533658A

United States Patent [19]

Benedict et al.

[11] Patent Number: 5,533,658

[45] Date of Patent: Jul. 9, 1996

[54] APPARATUS HAVING REPLACEABLE SHOES FOR POSITIONING AND GRIPPING TUBING

[75] Inventors: Robert B. Benedict, Dayton; Terry L. Kiger, Kettering, both of Ohio

[73] Assignee: Production Tube, Inc., Dayton, Ohio

[21] Appl. No.: 336,998

[22] Filed: Nov. 10, 1994

[51] Int. Cl.[6] ..... B65H 51/04

[52] U.S. Cl. ..... 226/172; 226/176

[58] Field of Search ..... 226/171, 172, 226/177, 192, 1, 45, 176; 254/265

[56] References Cited

U.S. PATENT DOCUMENTS

| | | | |
|---|---|---|---|
| 978,077 | 12/1910 | Travis | 226/172 |
| 1,999,151 | 4/1935 | Finley | 226/172 X |
| 3,915,075 | 10/1975 | Luke et al. | 226/172 X |
| 3,945,547 | 3/1976 | Ledebur | 226/172 |
| 3,946,918 | 3/1976 | Babbin et al. | 226/1 |
| 4,422,541 | 12/1983 | Lisec | 198/627 |
| 4,508,251 | 4/1985 | Harada et al. | 226/172 X |
| 5,009,353 | 4/1991 | Alquist | 226/172 |
| 5,188,174 | 2/1993 | Anderson, Jr. et al. | 226/172 X |

*Primary Examiner*—John P. Darling
*Attorney, Agent, or Firm*—Thompson Hine & Flory

[57] ABSTRACT

An apparatus for positioning and gripping tubing and/or bar stock for various applications. The apparatus comprises a frame; a pair of juxtaposed, inwardly facing guides, adjustably mounted on the frame; a pulley rotatably mounted on the frame at each end of the each guide; an endless, flexible guide belt surrounding each guide and being mounted on the pulley; a removable shoe removably mounted on each guide; a motor for driving the pulley so that the guide belts are rotated; wherein the tubing or bar stock inserted into one end of the apparatus is positioned and gripped by frictional engagement with the guide belts, and both the guides and the removable shoes are adjustable to accommodate tubing or bar stock having different outside diameters.

16 Claims, 5 Drawing Sheets

APPARATUS HAVING REPLACEABLE SHOES FOR POSITIONING AND GRIPPING TUBING

FIELD OF THE INVENTION

This invention relates to an apparatus for positioning and gripping tubing. In particular, this invention relates to a track drive apparatus which positions and grips tubing so that it can be cut, bent, welded or further fabricated.

BACKGROUND OF THE INVENTION

The nature of tubing makes it difficult to transport, position and grip so that it can be cut, welded, bent or further fabricated. Typically, standard mill length tubing of up to 20 feet (6 m) is transported on an arbor of sufficient length to accommodate the tubing by means of a feed mechanism. Understandably, the arbor and feed mechanism require a large amount of space for proper operation.

Another type of apparatus transports tubing by means of a hitch-feed apparatus. The hitch-feed apparatus moves the tubing by grasping it with a clamp and moving forward. Because the hitch-feed portion of the apparatus operates over a short distance, it requires multiple grasping and movement functions to move an extended piece of tubing. The hitch-feed clamp is grossly adjustable to accommodate tubing of different outside diameters but the clamp often mars the outside of tubing by leaving imprints from the teeth of the clamp. Furthermore, in some instances the clamping action becomes too tight and crushes the tubing thus rendering that particular piece of tubing useless.

Finally, tubing is held by manually adjustable clamps when cutting, bending and other operations are performed. These clamps, like the hitch feed apparatus, will mar the tubing if they are adjusted too tightly. They can also crush the tubing if adjusted extremely tightly.

Thus, a need has developed in the industry for a tube transport apparatus which is easier to load and operate, which occupies a smaller amount of space and which will not crush the tubing as it is fed through the apparatus.

SUMMARY OF THE INVENTION

The present invention provides an apparatus for positioning and gripping tubing for various applications. The apparatus includes a frame having four pulleys is driven by a motor. A pulley is located at each end of an adjustable guide, of which there are two. A guidebelt encircles two of the pulleys and an adjustable guide. Each adjustable guide includes an adjustable plate and a shoe. Each shoe has a groove therein to facilitate passage of tubing through the apparatus. The shoes are removable from the adjustable plates and maintained in position on the adjustable plates by means of the elastic tension created by the guidebelts.

The tubing travels through the apparatus by means of frictional engagement with the guidebelts. The apparatus includes a meter which measures the length of tubing fed through the apparatus measuring the rotations of one of the pulleys or of the motor drive shaft. After a measured length of tubing has been fed through the apparatus, the apparatus grips the tubing as it is operated on.

The apparatus can be adjusted to accommodate tubing of different outside diameters which prevents the tubing from being crushed. Firstly, the adjustable guides are movable vertically to increase or decrease the distance between the shoes. Secondly, because the shoes are removable, they can be replaced with shoes that accommodate the outside diameter of the preferred tubing or machined to a larger groove radius. Finally, each shoe includes a longitudinal groove which aligns the tubing as it is fed through the apparatus.

DETAILED DESCRIPTION

Figure 1:
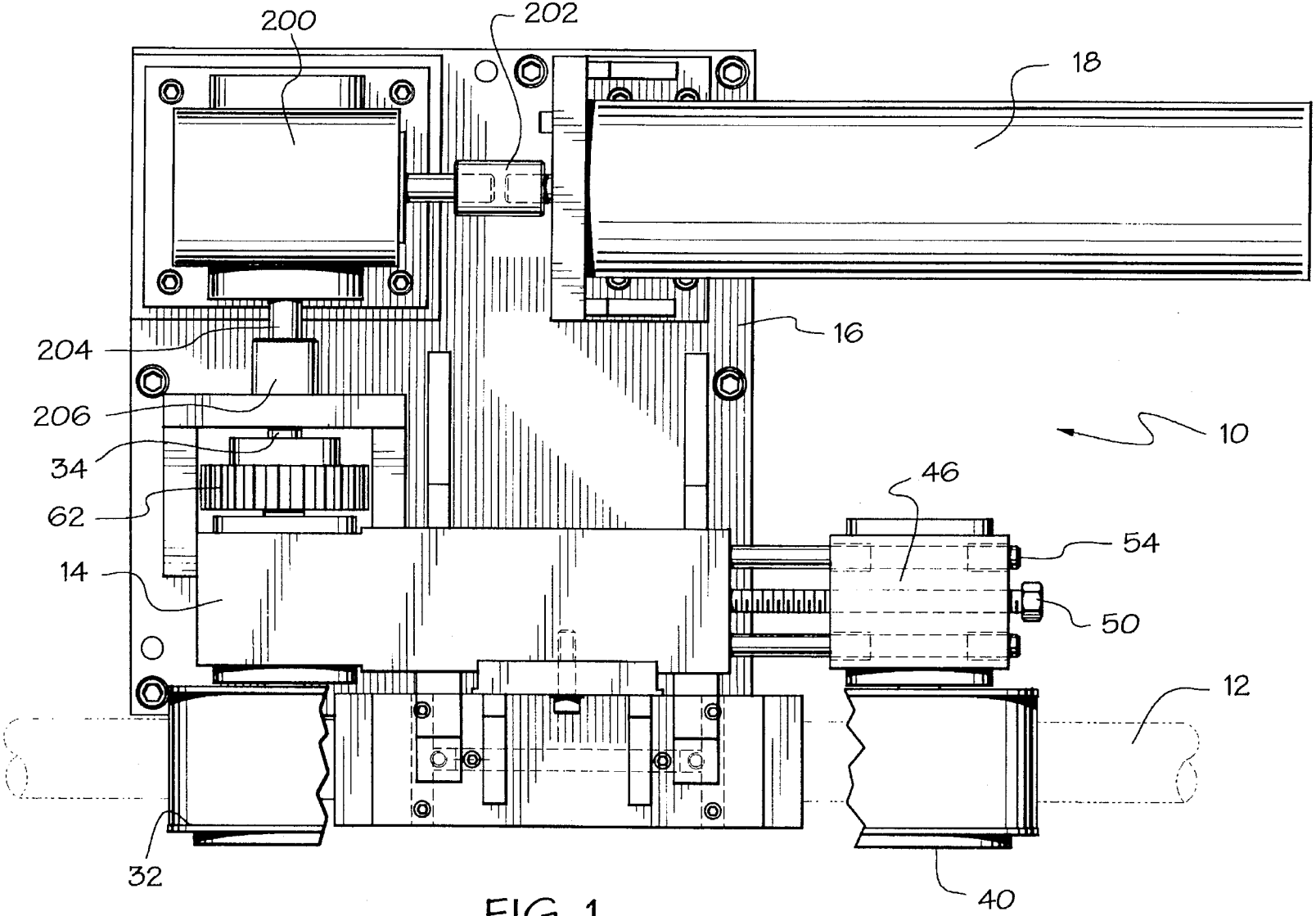
FIG. 1 is a plan view of the apparatus of the present invention.

As shown in FIG. 1, the track drive feeding apparatus 10 includes a frame 14, which has a generally rectangular shape, mounted on a base 16. Servo motor 18 and right angle converter 200 are also mounted on the base 16. Servo motor 18 is coupled to right angle converter 200 by means of coupling 202. Drive shaft 204 which extends from right angle converter 200 is coupled to axle 34 of pulley 30 by coupling 206.

Figure 2:
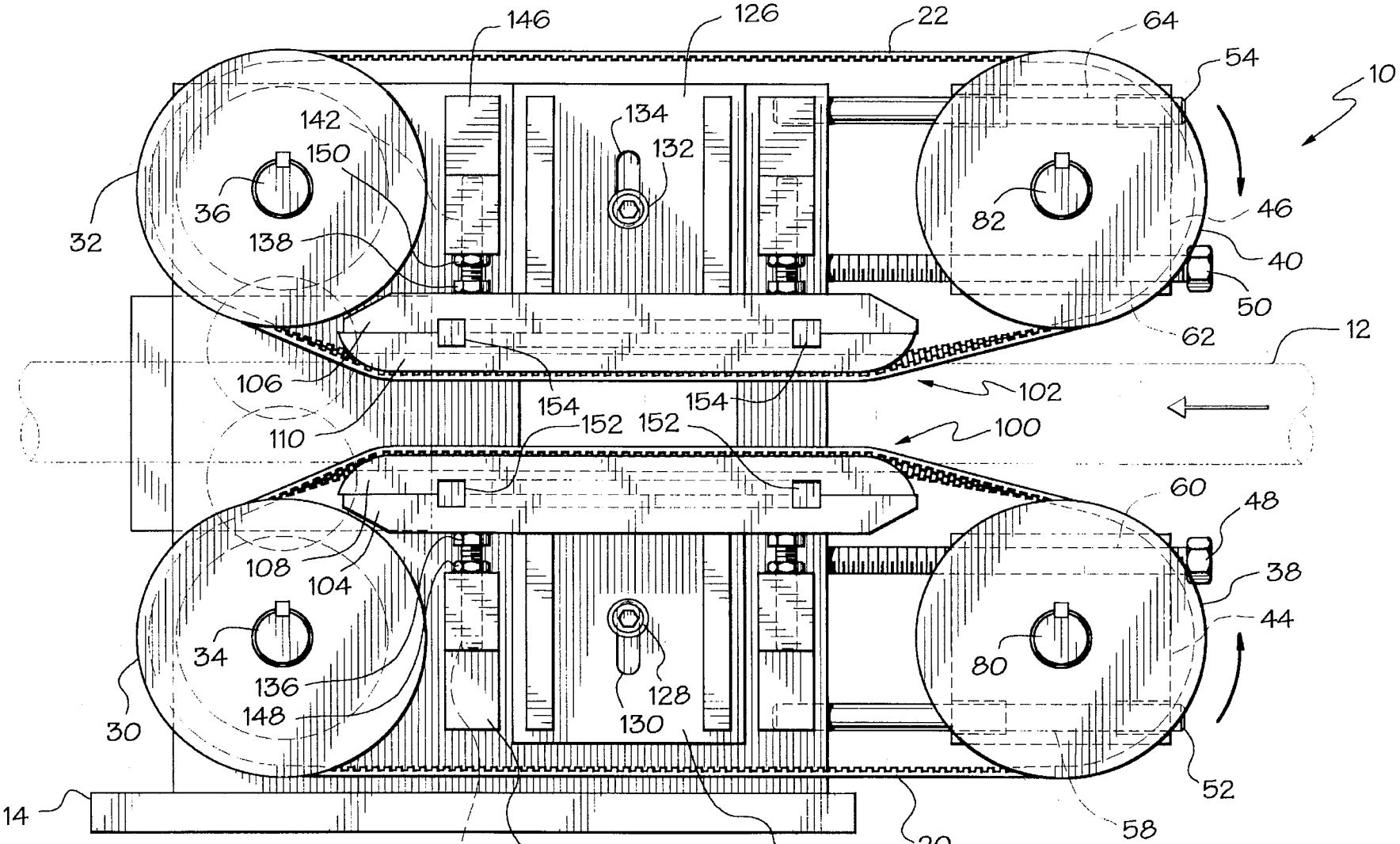
FIG. 2 is a side view of the apparatus of the present invention.
Figure 4:
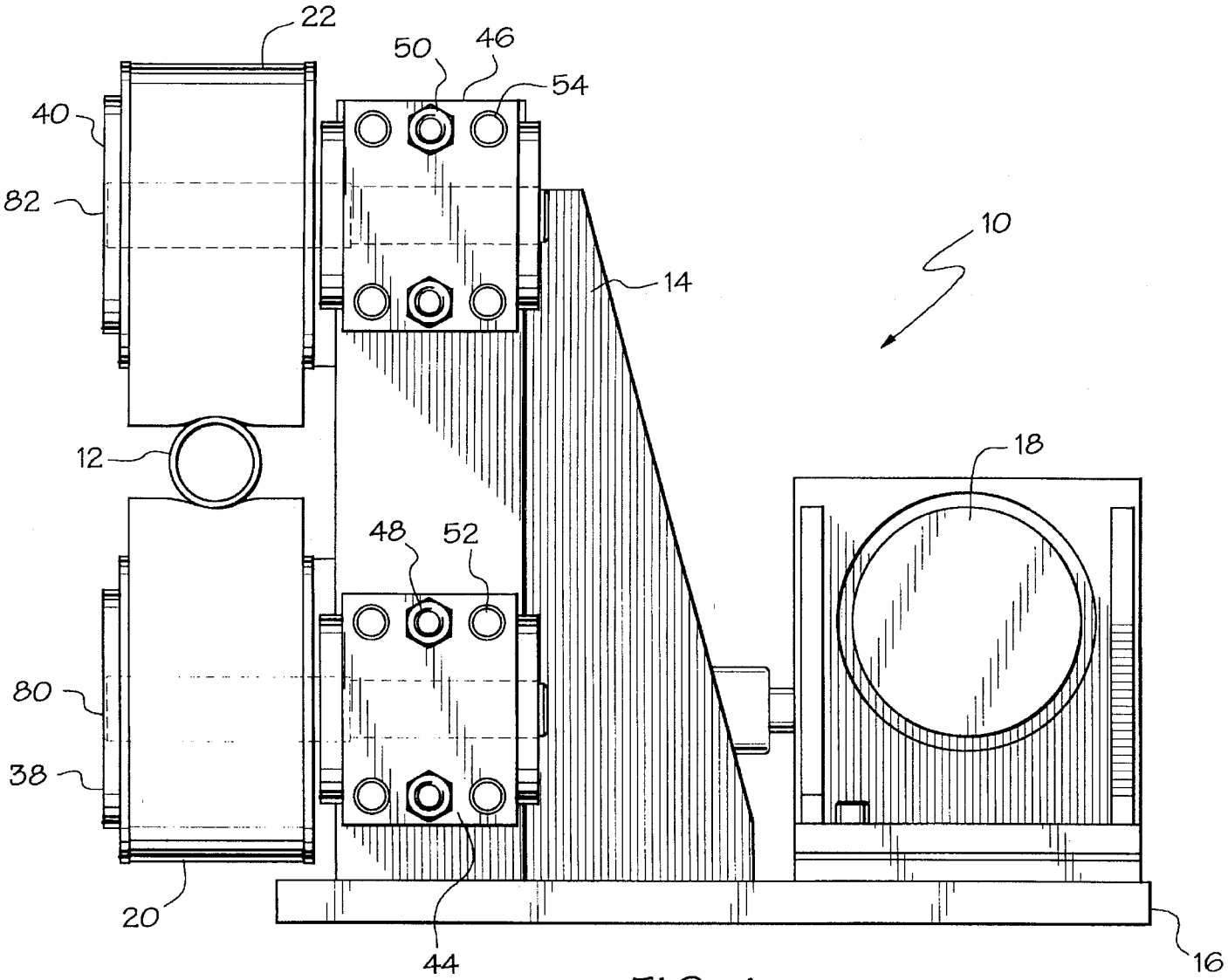
FIG.4 is a rear view of the apparatus of the present invention.

As seen in FIG. 2, pulleys 30 and 32 are mounted on axles 34 and 36, respectively. Axles 34 and 36 are rotatably mounted on frame 14. Pulleys 38 and 40 are mounted on axles 80 and 82 which are rotatably mounted in blocks 44 and 46. As shown in FIG. 4, blocks 44 and 46 are adjustably mounted on frame 14 by means of a pair of screws 48 and 50, respectively, and slides 52 and 54, respectively, of which there are four for each block 44 and 46. Screws 48 and 50 are mounted in frame 14 and slides 52 and 54 are journalled to frame 14. Block 44 includes slots 58 which engage rods 52 and threaded slot 60 which engages screw 48. Block 46 includes threaded slot 62 through which screw 50 passes and slots 64 through which rods 54 pass. Guidebelt 20 encircles pulleys 30 and 38, while guidebelt 22 encircles pulleys 32 and 40.

Figure 3:
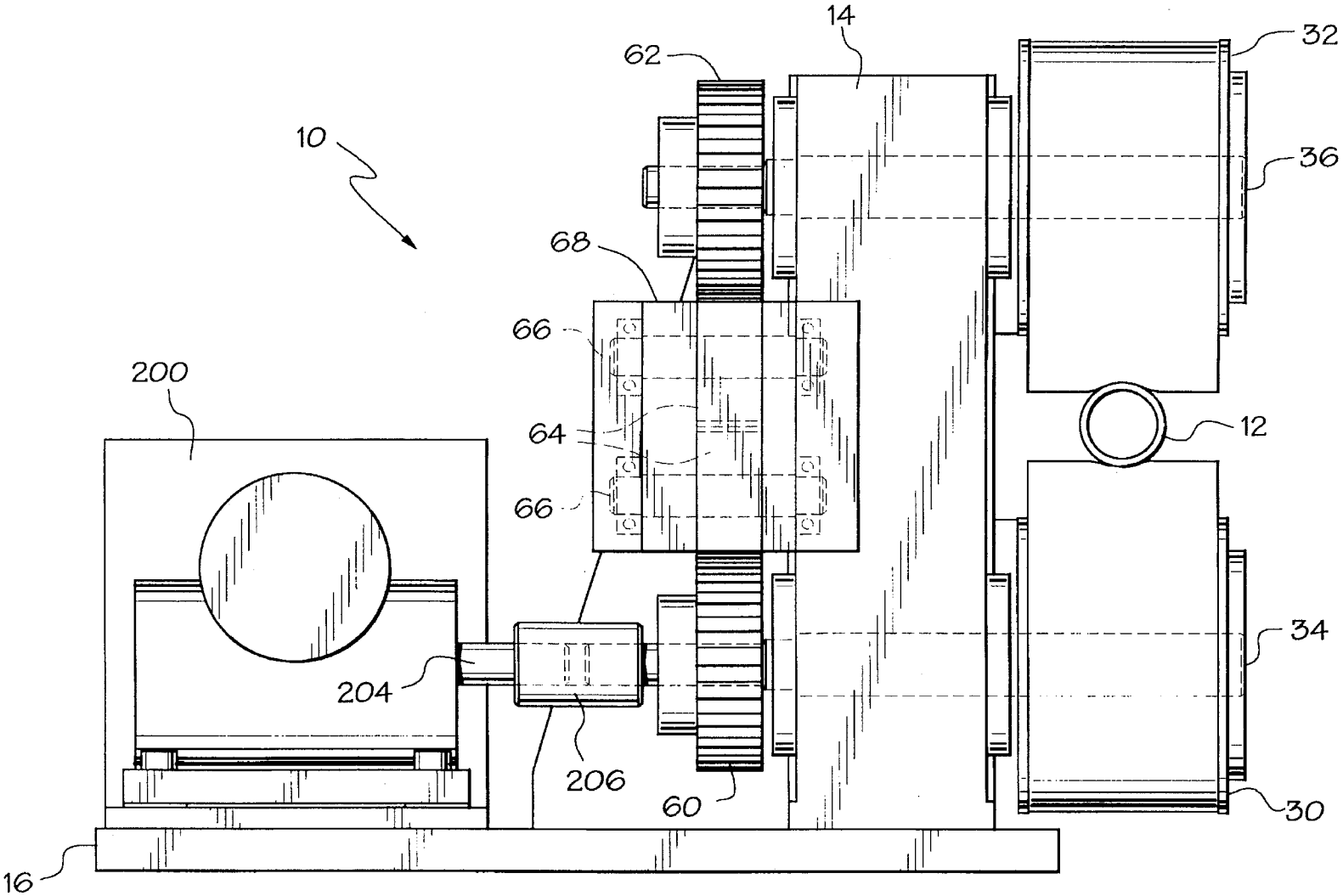
FIG. 3 is a front view of the apparatus of the present invention.

Drive shaft 204 of right angle converter 200 is coupled to axle 34 of pulley 30 by coupling 206, as shown in FIG. 3. Gear 160 is mounted on the end of axle 34 opposite pulley 30 and gear 62 is likewise mounted on the end of axle 36 opposite pulley 32. Gears 160 and 162 are linked to each other by gears 64. Gears 164 are mounted on bearings 66 which, in turn, are mounted in gear box 68.

As seen in FIG. 2, the apparatus 10 further includes two adjustable guides 100 and 102 through which the tubing 12 passes on the apparatus 10. Each, guide 100 and 102, includes an adjustable plate 104 and 106, respectively, and a shoe 108 and 110, respectively. Shoes 108 and 110 are maintained in position on adjustable plates 104 and 106, as discussed below. Adjustable plates 104 and 106 are welded to slides 124 and 126, respectively. Slide 124 is adjustably mounted on frame 14 by means of screw 128 which engages slot 130. Slide 126 is adjustably mounted on frame 14 by means of screw 132 which engages slot 134. Arms 144 and 146 are mounted on frame 14. Screws 136 and 138 are threadedly mounted in threaded slots 140 and 142 in arms 144 and 146, respectively. Screws 136 and 138 are adjusted by means of nuts 148 and 150, respectively, and the heads of screws 136 and 138 contact the surfaces of their respective plates 104 and 106.

Figure 5:
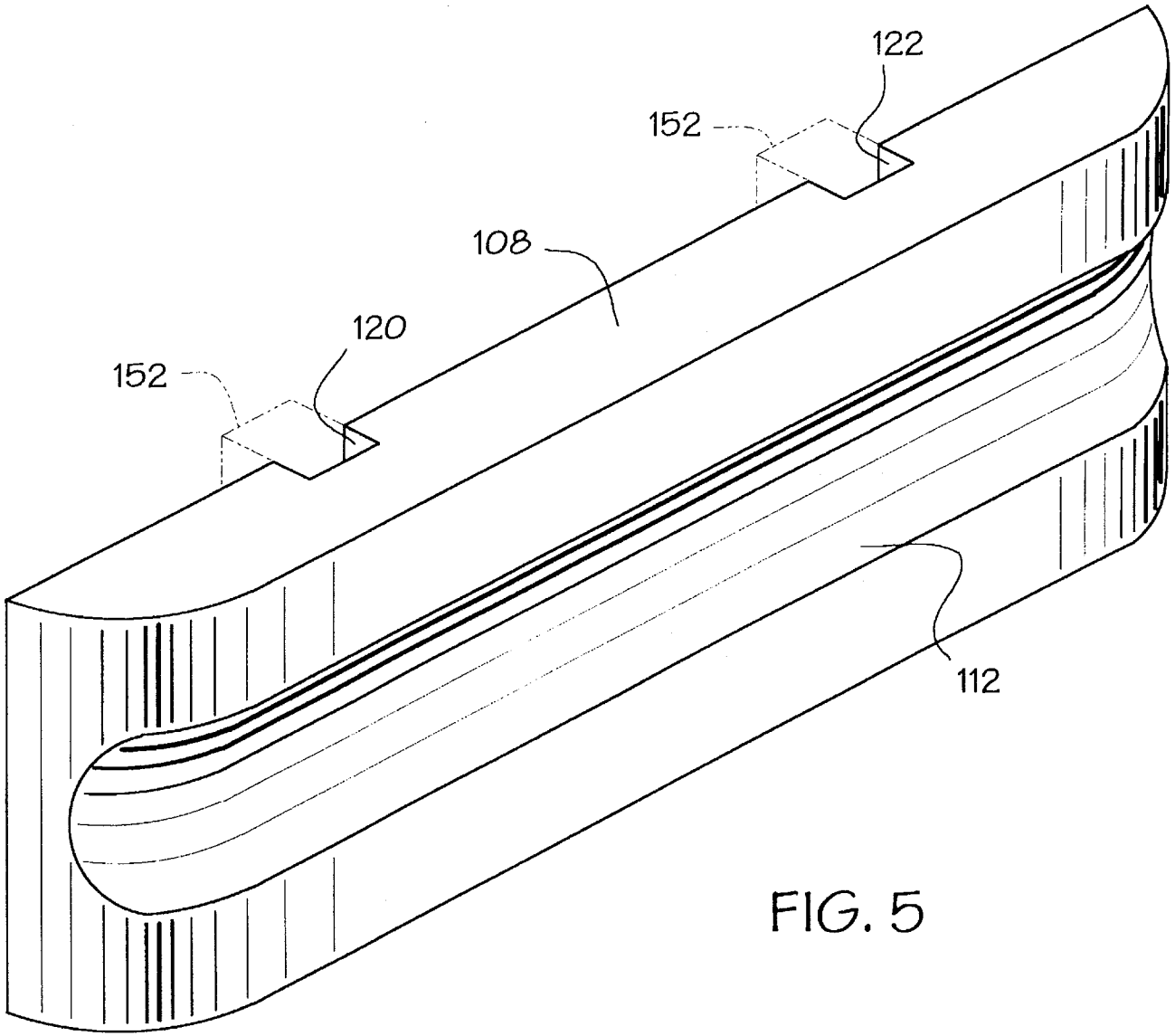
FIG. 5 is a perspective view of one of the shoes of the present invention.

As seen in FIG. 5, each shoe 108, shown, and 110, not shown, has a single groove 112 machined therein. The groove 112 is provided so that the apparatus can accommodate tubing 12 having different outside diameters, as will be discussed below. Returning to FIG. 2, shoes 108 and 110 are maintained in position on adjustable plates 104 and 106 by means of the tension created on their respective adjustable plates, 104 and 106, by belts 20 and 22, respectively. To prevent the shoes 108 and 110 from moving longitudinally, i.e., in the direction of rotation of their respective belts 20 and 22, each plate includes a pair of keys 152 and 154, respectively, which engage both the shoes 108 and 110 in slots 120 and 122 and the adjustable plates 104 and 106 in slots 116 and 118. To prevent shoes 108 and 110 from moving laterally, i.e., either toward or away from frame 14, each guide 100 and 102 also includes a third key, not shown, which engages corresponding slots in both the adjustable plate and the shoe. These corresponding slots, also not shown, extend perpendicularly between slots 120 and 122.

Servo motor 18 drives pulley 30 by means of right angle converter 200. Right angle converter 200 provides a 3:1 gear reduction. Although described herein as being a right angle drive, one skilled in the art will appreciate that this apparatus will function equally as well if a direct drive system is employed. One skilled in the art will also appreciate that differing gear ratios or no gear ratio can be employed with this apparatus. Pulley 30 rotates gear 60 which in turn rotates gears 164 and consequently drives pulley 32 by means of gear 162. Pulleys 30 and 32 drive their respective guidebelts 20 and 22 by means of frictional engagement. Pulley 30 also drives pulley 38 by means of belt 20 and pulley 32 drives pulley 40 by belt 22.

The tubing 12 to be conveyed can be inserted into either end of the apparatus 10. For the purpose of illustration, the tubing 12 is fed into the end of the apparatus 10 on which pulleys 34 and 36 are located. The tubing 12 is pulled between the two guides 100 and 102 by means of frictional engagement with belts 20 and 22. The rotational speed of belts 20 and 22 and, consequently, the speed at which the tubing 12 is moved through the apparatus 10 is adjusted by means of a conventional control apparatus (not shown). The tubing 12 is fed through the apparatus a distance equal to that which has been inputted to the control apparatus or until the operator determines that a sufficient amount of tubing has been fed through the apparatus 10.

A meter, not shown, associated with motor 18 measures the distance the tubing 12 moves through the apparatus 10. This meter is conventional and a suitable meter is available from Dynapar and has the tradename Maxlength 1. Although the meter is described herein as being associated with motor 18, one skilled in the art will appreciate that it may also be attached to any one of the pulleys.

To accommodate tubing 12 having varying outside diameters, guides 100 and 102 are adjustable vertically. To adjust guides 100 and 102, screws 128 and 132 are loosened and nuts 148 and 150 are rotated to move screws 136 and 138 vertically away from tubing 12. This allows slides 124 and 126 to be moved. Slides 124 and 126 are then adjusted to the appropriate distance to accommodate the outside diameter of the tubing 12. The movement of slides 124 and 126 changes the vertical distance between guides 100 and 102 and, subsequently, the distance between adjustable plates 104 and 106. Once plates 104 and 106 have been adjusted, screws 128 and 132 are then tightened securing slides 124 and 126 into position. After the plates 104 and 106 have been adjusted to the proper distance to accommodate tubing 12, screws 136 and 138 are then adjusted vertically toward the tubing 12 by nuts 148 and 150, respectively, to provide a clamping action on tubing 12. As screws 136 and 138 are adjusted, they provide a force on plates 104 and 106 directed toward the tubing 12. Thus, slides 124 and 126 provide a gross adjustment means and screws 136 and 138 provide a fine adjustment means to accommodate tubing of different sizes.

To further accommodate tubing 12 of different diameters, shoes 108 and 110 are removable from adjustable plates 104 and 106. Shoes 108 and 110 are easily removable because they are maintained in position on adjustable plates 104 and 106 solely by means of the elastic tension of guidebelts 20 and 22. The shoes 108 and 110 are constructed of a high molecular weight plastic which provides heat resistance and machinability along with low frictional engagement with belts 20 and 22. Because the shoes 108 and 110 are easily machinable, the radius of grooves 112 can be altered to accommodate tubing 12 having different outside diameters. Since shoes 108 and 110 are easily removable from plates 104 and 106, they can be easily replaced with other shoes having a groove radius which accommodates the preferred tubing 12.

To remove shoes 108 and 110 from plates 104 and 106, the tension on belts 20 and 22 must first be relieved to allow shoes 108 and 110 to be manually removed from adjustable plates 104 and 106. The tension on belts 20 and 22 can be relieved either by moving adjustable plates 104 and 106 away from each other or adjusting blocks 44 and 46 toward the frame 14 of the apparatus 10, as discussed below, or both methods. Shoes 108 and 110 are simply removed by lifting them from the surface of adjustable plates 104 and 106. Keys 152 and 154 and the third key can be removed from their respective shoes by lifting them from their respective retaining slots. Shoes 108 and 110 can be replaced with shoes having a groove radius which accommodates the outside radius of the tubing to be cut or shoes 108 and 110 can be machined to an appropriate radius and replaced on the apparatus 10.

Shoes 108 and 110 are replaced onto their respective adjustable plates 104 and 106 in the reverse order. Keys 152 and 154 are reinserted into their respective slots in shoes 108 and 110. Each of the third keys is also reinserted in its respective slots in its respective shoes. Shoes 108 and 110 are then positioned on the adjustable plates 104 and 106 by aligning the keys with their respective slots in adjustable plates 104 and 106.

Pulleys 30 and 32 must be adjusted to maintain the proper tension on belts 20 and 22 to maintain shoes 108 and 110 in position on adjustable plates 104 and 106. Pulleys 30 and 32 are adjusted by moving blocks 44 and 46 by means of screws 48 and 50. Screws 48 and 50 are turned so that blocks 44 and 46 either move toward or away from the frame 14 of the apparatus 10. Because blocks 44 and 46 are adjustably mounted on slides 52 and 54, blocks 44 and 46 move along slides 52 and 54 as screws 48 and 50 are adjusted. Thus, as blocks 44 and 46 are adjusted, pulleys 34 and 36 are also adjusted. To increase the tension on belts 20 and 22, blocks 44 and 46, with their respective pulleys 38 and 40, must be moved away from the frame 14 of apparatus 10. Conversely, to reduce the tension on belts 20 and 22, blocks 44 and 46 are moved toward frame 14 of apparatus 10. Once the necessary tension has been provided to the belts 20 and 22, the apparatus 10 is ready for operation.

Grooves 112 in shoes 108 and 110 create a self-centering mechanism. Because shoes 108 and 110 have grooves 112 respectively, machined therein, belts 20 and 22 deform into grooves 112 as the tubing 12 passes through the apparatus creating an arched area conforming to the shape of grooves 112 as the belts 20 and 22 travel over their respective shoes. Tubing 12 fed into the apparatus 10 at an angle to the direction of rotation of belts 20 and 22 becomes centered in the apparatus 10 by means of engaging the grooves 112. As the tubing 12 is moved through the apparatus 10, it moves to the point of least resistance, which, in the case of this apparatus, occurs between grooves 112 and becomes centered as it passes through the apparatus 10.

In a preferred embodiment, the apparatus 10 can be used in conjunction with a tube cutting machine. When used in conjunction with a tube cutting machine, the tubing 12 is fed through the apparatus 10 until it passes through the cutting head of the cutting machine. The portion of the tubing 12 extending past the cutting head is cropped and then the tubing 12 can be cut. Once it has been cropped, the tubing 12 becomes aligned with the fixed die of the cutting head. The apparatus 10 then feeds the tubing 12 through the cutting head a distance equal to the required length for the cut pieces as inputted into the control device and measured by the meter. Once the meter has measured the appropriate length of tubing 12 moved through the cutting head, it sends a signal to the control apparatus which in turn commands the cutting head to cut the tubing 12. When the proper length of tubing 12 has been positioned, the cut is then made and the tubing 12 is fed through the apparatus 10 and cut until the tubing 12 is exhausted. The length of tubing 12 remaining between the cutting head and the apparatus 10 after the tubing has been cut is discarded as scrap.

One skilled in the art will appreciate that although the apparatus has been described herein as providing a means for gripping and positioning tubing, any similar material such as bar stock may also be fed through the apparatus 10.

Having described the invention in detail and by reference to preferred embodiments thereof, it will be apparent that modifications and variations are possible without departing from the scope of the invention defined in the appended claims.

What is claimed is:

1. An apparatus for positioning and gripping tubing or bar stock comprising:

a frame;

a pair of juxtaposed, inwardly facing guides, adjustably mounted on the frame;

a pulley rotatably mounted on the frame at each end of each guide;

an endless, flexible guide belt surrounding each guide and being mounted on the pulleys;

a removable shoe removably mounted on each guide;

a motor for driving the pulleys so that the guide belts are rotated;

wherein tubing or bar stock inserted into one end of the apparatus is positioned and gripped by frictional engagement with the guide belts, and both the guides and the removable shoes are adjustable to accommodate tubing or bar stock having different outside diameters.

2. The apparatus of claim 1 wherein each guide further includes a support which is adjustably mounted on the frame wherein by adjusting the position of the support with respect to the frame, the distance between the guides can be varied so that the apparatus accommodates tubing or bar stock having different outside diameters.

3. The apparatus of claim 2 wherein the removable shoes are maintained in position on their respective adjustable supports by the elastic tension of the guidebelts.

4. The apparatus of claim 3 wherein each removable shoe includes a concave recess therein having a diameter corresponding to the outside diameter of the tubing.

5. The apparatus of claim 4 wherein the removable shoes are constructed of a high molecular weight plastic which provides heat resistance and machinability along with low frictional engagement with the belts.

6. The apparatus of claim 5 wherein at least two of the pulleys are adjustable to provide variable tension on the guidebelts.

7. The apparatus of claim 6 wherein the means for driving the pulley is a servo motor.

8. The apparatus of claim 7 wherein the the motor drives the pulleys by means of a right angle drive.

9. The apparatus of claim 7 wherein the motor drives the pulleys by means of a direct drive.

10. The apparatus of claim 7 wherein the apparatus further comprises a controller for controlling the length of tubing or bar stock fed through the apparatus.

11. The apparatus of claim 10 wherein the apparatus further comprises a meter for measuring the length of tubing processed through the apparatus.

12. The apparatus of claim 6 wherein the adjustable support is mounted on the frame by a slide, the slide including a slot engaged by a screw.

13. The apparatus of claim 12 further including an arm mounted on the frame on each side of each adjustable support, each arm receiving a screw that engages the adjustable support such that when the screws are adjusted, the screws can be moved to cause the adjustable supports to provide a clamping action about the tubing.

14. The apparatus of claim 3 wherein each shoe is further maintained in position on that shoes adjustable support by means of at least one key which engages a slot in the adjustable support and a slot in the removable shoe, the key and slot laying perpendicular to the direction of rotation of the guidebelt.

15. The apparatus of claim 1 wherein the motor for driving one of the pulleys drives a first pulley which drives a first guidebelt and the first pulley drives a second pulley by means of a linkage, the second pulley driving a second guidebelt.

16. An apparatus for positioning and gripping tubing in relation to a tube cutting machine comprising:

a frame;

a pair of juxtaposed inwardly facing guides, adjustably mounted on the frame, each guide comprising a support which is adjustably mounted on the frame and a removable shoe which is carried on the support, each shoe having a concave recess formed therein, the recess having a diameter approximately equal to the outside diameter of the tubing;

a pulley rotatably mounted on the frame at each end of the guides;

an endless, flexible guide belt surrounding each guide and being mounted on the pulleys;

a motor for driving the pulley so that the guide belts are rotated;

a controller for controlling the length of tubing fed through the apparatus; and a meter for measuring the length of tubing fed through the apparatus; wherein tubing inserted into one end of the apparatus is positioned in a cutting head of a tube cutting machine by frictional engagement with the guide belts, the guides are adjustable to accommodate tubing having different outside diameters, and at least two of the pulleys are adjustably mounted to provide variable tension on the guide belts.

* * * * *

UNITED STATES PATENT AND TRADEMARK OFFICE

CERTIFICATE OF CORRECTION

PATENT NO. : 5,533,658

DATED : July 9, 1996

INVENTOR(S) : Robert B. Benedict et. al.

It is certified that error appears in the above-indentified patent and that said Letters Patent is hereby corrected as shown below:

Title page, item [73] Assignee: replace "Production Tube, Inc." with --Production Tube Cutting, Inc.--.

Column 6, claim 14, line 40, "shoes" should be --shoe's--.

Signed and Sealed this

Eleventh Day of March, 1997

Bruce Lehman

*Attest:*

BRUCE LEHMAN

*Attesting Officer*

*Commissioner of Patents and Trademarks*